United States Patent [19]

Maenishi et al.

[11] Patent Number: 4,692,728

[45] Date of Patent: Sep. 8, 1987

[54] SELF-ALIGNING SPRING MECHANISM FOR AN ELECTRICAL SWITCH

[75] Inventors: Kozo Maenishi, Nagaokakyo; Youichi Nakanishi, Kyoto, both of Japan

[73] Assignee: Omron Tateisi Electronics Co., Kyoto, Japan

[21] Appl. No.: 780,454

[22] Filed: Sep. 26, 1985

Related U.S. Application Data

[63] Continuation-in-part of Ser. No. 657,589, Oct. 4, 1984, Pat. No. 4,647,885.

[30] Foreign Application Priority Data

Oct. 5, 1983 [JP] Japan ..... 58-187232

[51] Int. Cl.[4] ..... H01H 3/00

[52] U.S. Cl. ..... 335/192; 335/46; 335/79; 335/81; 335/83; 200/251

[58] Field of Search ..... 335/192, 46, 78, 79, 335/80, 81, 82, 83; 200/250, 251, 260, 340

[56] References Cited

U.S. PATENT DOCUMENTS 3,517,358 6/1970 Davis ..... 335/192

*Primary Examiner*—Patrick R. Salce

*Assistant Examiner*—Anita M. Ault

*Attorney, Agent, or Firm*—Wegner & Bretschneider

[57] ABSTRACT

An electromagnetically operated relay having a spring which compensates for misalignment of a moveable block as shown and described. The movable block reciprocates within said relay housing in response to forces exerted by the electromagnet. The block includes projections which engage openings in an leaf spring which biases the block. The spring to block engagement provides compensation for misalignment of the block, and for unequal forces applied to the block and/or spring.

The compensation provided by the spring to block engagement is achieved by a loose fit between projections on the slidable block and openings in the spring. The freedom of movement provided by the slots allows the spring to bulge in a direction opposite to the force on the spring end with respect to the sliding block. By creation of this bulge between the two projections on the sliding block, compensation is provided to the spring system. The compensation is produced by the bulge which in turn forces the opposite end of the spring to move in the direction of movement of the first end. By this compensation, parallel movement of the sliding block is assured.

18 Claims, 8 Drawing Figures

SELF-ALIGNING SPRING MECHANISM FOR AN ELECTRICAL SWITCH

CROSS REFERENCE TO RELATED APPLICATION

This application is a continuation-in-part of U.S. patent application Ser. No. 657,589, filed Oct. 4, 1984, now U.S. Pat. No. 4,647,885.

BACKGROUND OF THE INVENTION

This invention relates to an electromagnetic relay, and in particular to an electromagnetic relay in which a movable block reciprocates in parallel relation for activating a contact mechanism.

DESCRIPTION OF THE PRIOR ART

Conventionally, in an electromagnetic relay of this type, a restoring means for the movable block is constructed by securing a middle portion of a sheet spring to a middle portion of a movable table by fitting means or the like so as not to become loose, and by engaging the two ends of this sheet spring to a fixed block. The spring is prevented from moving about the projection from the block which holds the spring.

However, according to such a structure, there is a shortcoming that if the spring forces at the two ends of the sheet spring are not uniform because of some error in the bending angle, then the action timing of the movable block tends to be deteriorated, and it tends to move obliquely instead of in parallel relation, thereby damaging the action properties of the contact mechanism.

BRIEF SUMMARY OF THE INVENTION

A primary object of this invention is to provide an electromagnetic relay in which the instability of the action of the movable block arising from the unevenness of the spring forces of the sheet spring is diminished and the action properties are improved.

To accomplish such an object, the electromagnetic relay of this invention is characterized by having two engagement portions provided in lengthwise mid portions of a sheet spring loosely engaged to projections provided in the movable block and by two ends of this sheet spring being engaged to a fixed block whereby the movable block is imparted with restoring force. The uneven bending produced by one spring end produces a bulge in the region between the projections which in turn produces a movement of the second end of the spring in the same direction as the first movement.

DESCRIPTION OF THE DRAWINGS

The drawings show an embodiment of the electromagnetic relay of this invention.

DETAILED DESCRIPTION OF THE PREFERRED EMBODIMENT

Figure 1:
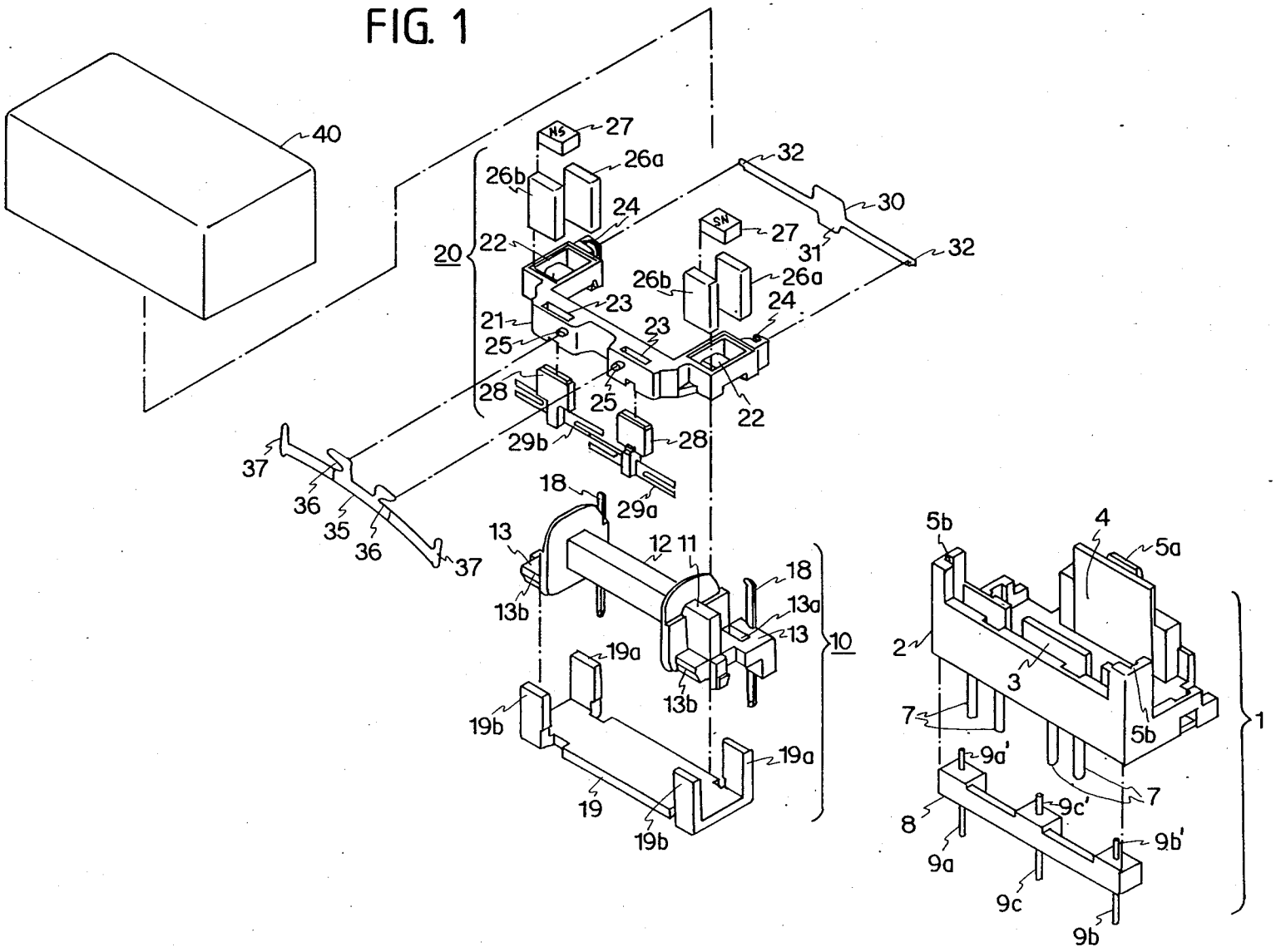
FIG. 1 is an exploded perspective view.

In FIGS. 1 to 4, the electromagnetic relay of this invention is built as a high frequency relay and is generally comprised of a fixed block 1, and electromagnetic unit 10, a movable block 20, a pair of sheet springs 30, 35, and a casing 40.

The fixed block 1 is made by fixedly securing a terminal block 8 having fixed terminals 9*a*, 9*b*, 9*c* to a rectangular slot 3 of a base 2 which is integrally formed from appropriate resin. The contacts (tips) 9*a*', 9*b*'*l*, 9*c*' of the fixed terminals are located in the slot and the internal wall of the slot 3 is provided with the ground contacts 6*a*, 6*b*, . . . 6*f* opposite to the contacts 9*a*', 9*b*', 9*c*'. Four ground terminals 7 project from the reverse surface of the base 2 and the ground terminals 7 are connected to the ground terminals 6*a*, 6*b*, . . . 6*f* by way of electroconductive film plated on the surface of the base 2. It goes without saying that the electroconductive film is insulated from the fixed terminals 9*a*, 9*b*, 9*c*.

The electromagnetic unit 10 is made by inserting an I-shaped iron core 11 through a spool 12, winding a coil 17 therearound, and integrally connecting the spool 12 and a yoke 19 and is attached to a depression 4 of the base 2. The spool 12 is connected to the yoke 19 by inserting a projection piece 19*a* of the yoke 19 into a hole 13*a* of a base block and engaging a side portion 13*b* of the base block to a projection piece 19*b*. And coil terminals 18 are mounted to the base blocks 13 and project downwardly from the base 2.

The movable block 20 is built by fixedly securing the armatures 26*a*, 26*b* to frame portions 22 of the movable body 21 which is integrally formed with appropriate resin and interposing permanent magnets 27 therebetween and by fittingly inserting insulator bodies 28 having movable contact pieces 29 into holes 23. This movable body 21 is so disposed that the armatures 26*b* oppose the projecting ends of the iron core 11 from the spool 12 at a fixed gap and are interposingly held by sheet springs in a reciprocable manner in parallel relation along the directions indicated by arrows A—A'.

A projecting piece 31 in a middle portion of the sheet spring 30 is inserted into a groove 5*a* of the base 2 and the two ends of the sheet spring 30 are inserted into grooves 24 of the movable body 21. Notches 36 of the sheet spring 35 loosely receive small projections 25 formed in the movable body 21 and the two ends of the sheet spring 35 are inserted into grooves 5b of the base 2.

In the above described structure, when the coil 17 is not magnetized, the movable block 20 is affected by the magnetic force of the permanent magnets 27 in such a manner that an attractive force acts between the pole surfaces of the iron core 11 and the armatures 26*b*, the movable block 20 moves in the direction indicated by the arrow A', the two ends of the movable contact piece 29 a engage to the contacts 9*b*', 9*c*', and the two ends of the movable contact piece 29*b* contact the ground terminals 6*a*, 6*b*.

When the coil 17 is energized, an attractive force is produced between the pole surfaces formed in the two ends of the iron core 11, and the armatures 26*a* in such a manner that the movable block 20 moves in the direction indicated by the arrow A, the two ends of the movable contact piece 29*b* contact the contacts 9*a*', 9*c*', and the two ends of the movable contact piece 29*a* contact the ground contacts 6*d*, 6*f*.

Figure 6:
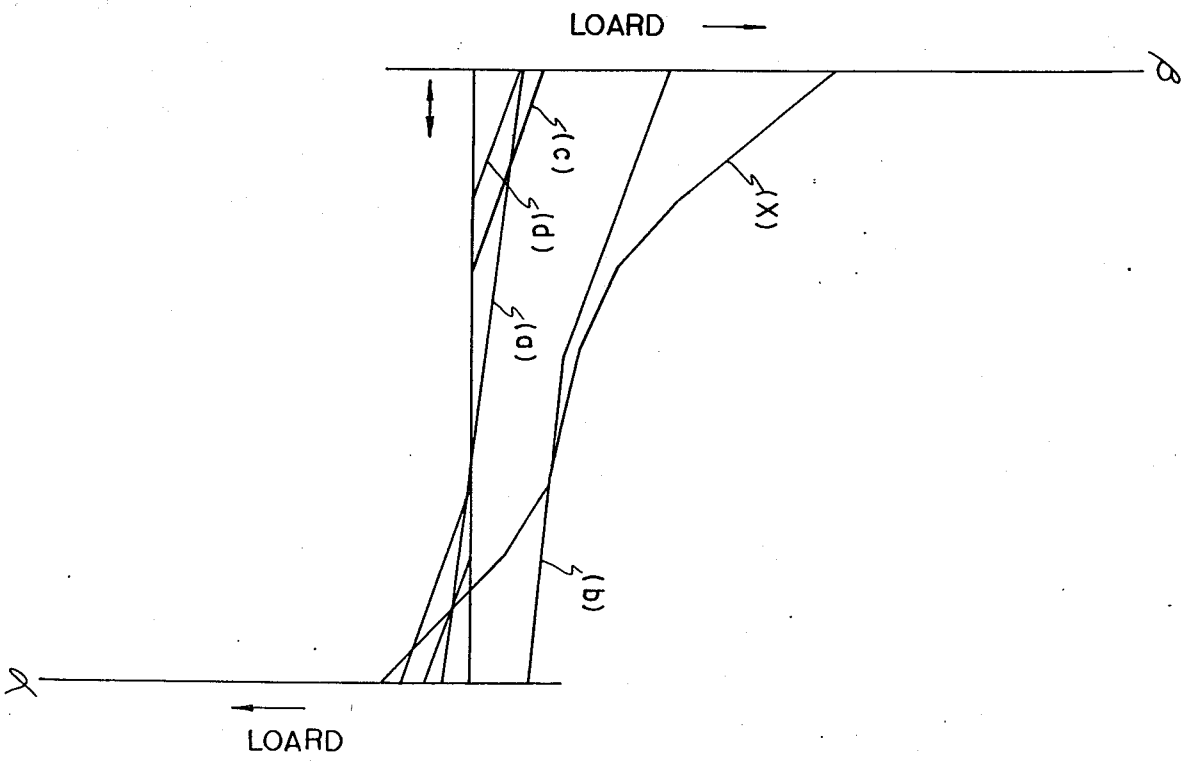
FIG. 6 is a graph showing a load curve.

The load curve in the action of the above described embodiment is shown by a curve X shown in FIG. 6. This load curve is made by combining the spring forces a, b of the sheet springs 30, 35 and the spring forces c, d of the movable contact pieces 29*a*, 29*b*. The adjustment of the load curve is made by primarily changing the spring forces arising from the bending angles of the sheet springs 30, 35. As clearly shown in FIG. 6, the spring force a of the sheet spring 30 is expressed by an inclined straight line, and its change causes an overall vertical displacement of the load curve. The spring force b of the sheet spring 35 is indicated by a straight line which is bent in a middle portion of the stroke of the movable block 20 and its change primarily determines the inclination angle of the load curve.

Meanwhile, because the notches 36 of the sheet spring 35 loosely receive the small projections 25 of the movable body 21, even when there is some unevenness between the spring forces at the two ends the sheet spring 35 by itself shifts itself according to the gap between the notch 36 and the small projection 25 and the difference between the spring forces is absorbed, thereby allowing reciprocating motion of the movable block 20 with an appropriate degree of parallel relation.

Figure 4:
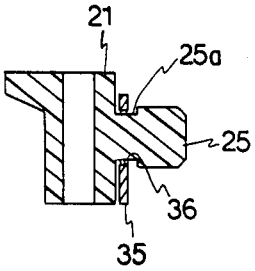
FIGS. 4 and 5 are a sectional view and a plan view of an essential portion.
Figure 5:
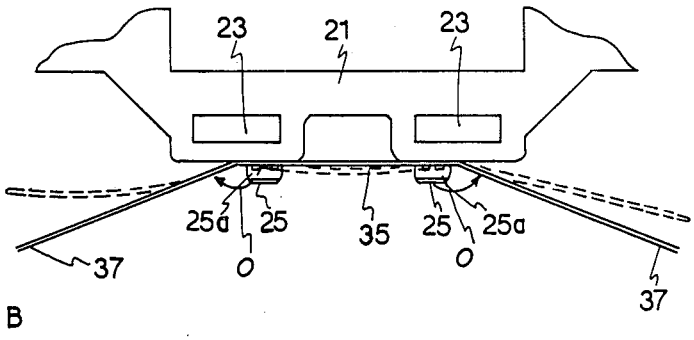

Specifically, as shown in FIGS. 4 and 5, notches 25*a* are formed above and below the root of the projection 25 projecting from the movable body 21, and the notch 36 of the sheet spring 35 loosely receives this root portion. Therefore, the sheet spring 35 is freely movable in four or eight directions in the vertical plane by the distances corresponding to the gap between the notch or opening 36 and the root of the small projection 25 and is prevented from coming off.

Figure 2:
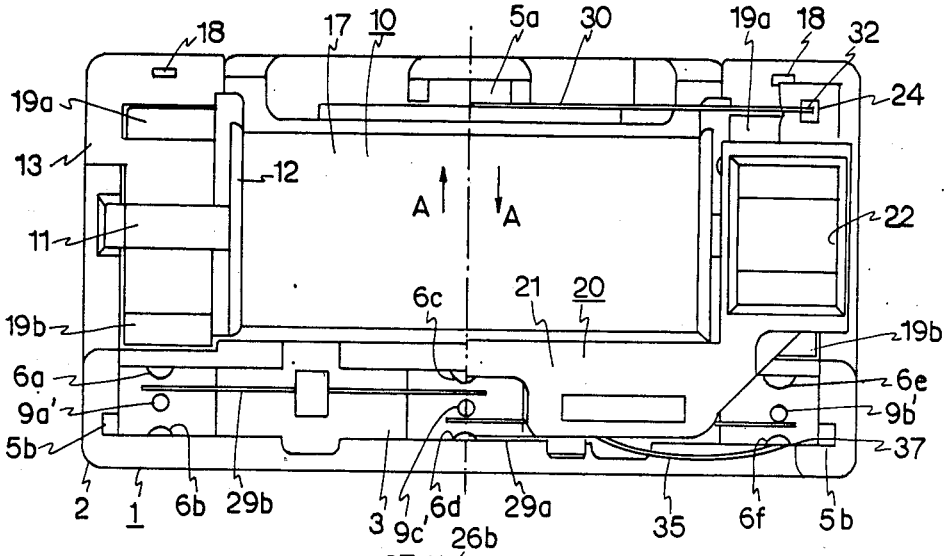
FIG. 2 is a plan view.
Figure 3:
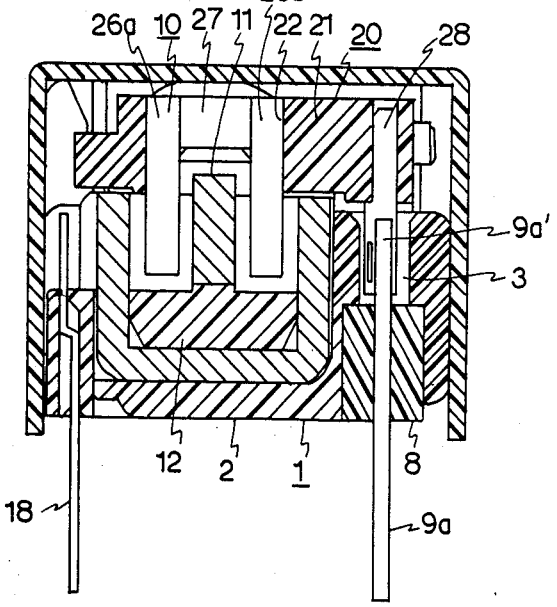
FIG. 3 is a sectional view.

The spring 35 extends transversely to the movement of the block 20 as shown by arrows A and A′ of FIG. 2.

And as shown in FIG. 5, when a pressing force in the direction indicated by the arrow B acts upon the left end 37, the left support portion is shifted slightly and the middle portion of the sheet spring 35 is bulged out and the right support portion is shifted slightly and the right end 37 also bends in the same direction as that indicated by the arrow B. This shift of the spring with respect to the left support is in a longitudinal direction with respect to the spring. This slight shift perits the center of the spring to bulge forward in the direction of block movement. This shift is transverse to the direction of block movement.

In other words, even when there is unevenness in the bending angles of the sheet spring 35, it adjusts itself so that the angle theta is identical in any instance, by automatic compensation. As a result, the spring forces at the two ends 37 of the sheet spring 35 become equal to each other, and the instability that the movable block 20 is inclined as it is activated is eliminated, and the action properties of the switching of the contact mechanism are improved.

Figure 5A:
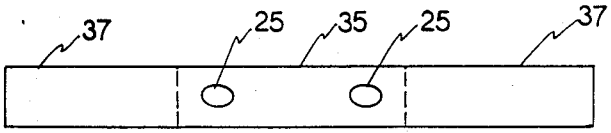
FIGS. 5*a* and 5*b* show details of the spring and the opening in the spring.
Figure 5B:
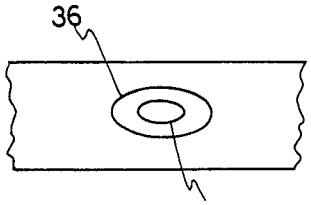

As can be seen in FIG. 5*b*, opening or notch 36 is larger than notch 25*a* of projection 25 and extends in a longitudinal direction.

The electromagnetic relay of this invention is not limited by the above described embodiment, but may be modified in various manners, without departing from the spirit of the invention. For instance, the engagement portion of the sheet spring 35 may not be a notch 36, but may be a hole (see FIGS. 5*a*, 5*b*), and may be straight, without being bent at the ends 37 thereof. However, if the sheet spring 35 is bent along the direction of its action, as shown in FIG. 5, the fulcrum of the sheet spring 35 itself is more stabilized, and the ends 37 are prevented from engaging to the movable body 21, as an advantage.

As can be seen from the above description, according to this invention, because two engagement portions provided in the lengthwise middle portions of the sheet spring are loosely engaged to the projections provided in the movable block, the spring forces of the sheet spring are automatically adjusted by the gap in the loosely engaged portion, the unstable action is eliminated, and the action properties are improved.

What is claimed:

1. A movable block switch mechanism which compensates for unevenness of spring force on the movable block, comprising:

a base;

a movable block having projections; and a sheet spring having openings which engage to the projections of the movable block and having ends which engage to the base, and wherein deflection of at least one of the ends of the sheet spring causes the portion of the spring between the spring openings to bulge in a direction opposite to the direction of deflection of the spring.

2. The apparatus according to claim 1 wherein the sheet spring openings are slots in the sheet spring.

3. The apparatus of claim 2 wherein the slots extend in a direction which is transverse to the direction of movement of the movable block.

4. The apparatus of claim 2 wherein the projections of the movable block have means for retaining the spring slots.

5. The apparatus of claim 1 wherein the movable block has shoulders separated by a space and wherein the projections of the movable block are located on the shoulders.

6. The apparatus of claim 1 wherein the bulge causes the non-deflected end of the spring to move in the same direction as the deflected end.

7. The apparatus of claim 1 wherein each angle between the base and a side of the bulge of the spring is the same because of the compensation produced by deflection of the spring at the bulge.

8. The apparatus of claim 1 wherein the slots lie on one edge of the sheet spring and are open on one end in the direction of the end of the spring adjacent to the slot.

9. The apparatus of claim 1 wherein the projections of the movable block have notches formed at the root of the projections which receive the sheet spring openings.

10. The apparatus of claim 9 wherein the notches retain the spring on the movable block.

11. An electromagnetic relay, comprising:

a base;

an electromagnetic unit having at least a pair of iron core pole surfaces projecting from each of at least two ends of a wire wound spool;

a pair of armatures opposing said iron core pole surfaces;

a movable block means for providing parallel, reciprocating motion;

a contact mechanism which is activated by said parallel reciprocating motion of the movable block means; and a sheet spring means having ends which engage the base and having engagement portions for engaging the movable block means.

12. The apparatus of claim 11 wherein the engagement portions comprise elongated slots in the sheet spring.

13. The apparatus of claim 12 wherein the elongated slots engage projections on the movable block means.

14. The apparatus of claim 12 where the slots extend in a direction parallel to the longitudinal axis of the spring.

15. The apparatus of claim 12 wherein the slots are open-ended notches which receive projections on the movable block means.

16. The apparatus of claim 12 wherein the spring portions are free to move with respect to the movable block means and in a direction transverse to the direction of movement thereof.

17. The apparatus of claim 11 wherein the sheet spring extends in a transverse direction with respect to the parallel reciprocating motion of the movable block means.

18. The apparatus of claim 11 wherein movement of the movable block means against the resistance of the spring causes the spring to bulge away from the movable block means in the region of the spring between slots and in the direction of movement of the movable block means.

* * * * *